US006361449B1

(12) United States Patent
Holly

(10) Patent No.: US 6,361,449 B1
(45) Date of Patent: Mar. 26, 2002

(54) GOLFER'S SWING TRACER

(76) Inventor: George Warren Holly, 5815 Morgan Pl. #35, Stockton, CA (US) 95219

( * ) Notice: Subject to any disclaimer, the term of this patent is extended or adjusted under 35 U.S.C. 154(b) by 0 days.

(21) Appl. No.: 09/626,734

(22) Filed: Jul. 27, 2000

Related U.S. Application Data

(60) Provisional application No. 60/156,134, filed on Sep. 27, 1999.

(51) Int. Cl.[7] ..... A63B 53/06
(52) U.S. Cl. ..... 473/237; 473/326
(58) Field of Search ..... 473/237, 257, 473/326

(56) References Cited

U.S. PATENT DOCUMENTS

| | | | | |
|---|---|---|---|---|
| 2,804,306 A | | 8/1957 | Chedister et al. | 273/186 |
| 3,037,777 A | | 6/1962 | Chedister et al. | 273/186 |
| 3,037,778 A | | 6/1962 | Chedister et al. | 273/186 |
| 3,411,789 A | * | 11/1968 | Wariner | 473/237 |
| 3,649,028 A | | 3/1972 | Worrell | 273/186 |
| 3,649,029 A | | 3/1972 | Worrell | 273/186 |
| 3,687,459 A | * | 8/1972 | Swords | 473/237 |
| 3,776,555 A | | 12/1973 | Hagaman | 273/186 |
| 3,820,130 A | | 6/1974 | Cornelison et al. | 354/34 |
| 3,820,133 A | | 6/1974 | Adorney et al. | 354/60 |
| 4,911,450 A | | 3/1990 | Rabold | 273/186 |
| 5,120,064 A | * | 6/1992 | Cerami | 473/237 |
| 5,470,071 A | * | 11/1995 | Hsu et al. | 473/237 |
| 5,803,826 A | * | 9/1998 | Perrine | 473/278 |

FOREIGN PATENT DOCUMENTS

| | | | |
|---|---|---|---|
| HU | 5620376 | 4/1997 | 473/233 |

* cited by examiner

*Primary Examiner*—Mark S. Graham
*Assistant Examiner*—Raeann Gorden

(57) ABSTRACT

A device to trace and record the path of a golfer's swing comprising a golf club, a refillable reservoir tube for water or other flowable material, and a mat with blotter-like surfaces; the reservoir tube having a small diameter orifice at its lower end and having a means for refilling at its upper end; the reservoir tube being situated in a hole through the club head. A golfer's swing of the golf club will cause a thin jet of water to issue through the small diameter orifice by centrifugal and inertial forces resulting in an immediately visible trace on the mat, showing the golfer how his or her swing may be improved.

8 Claims, 2 Drawing Sheets

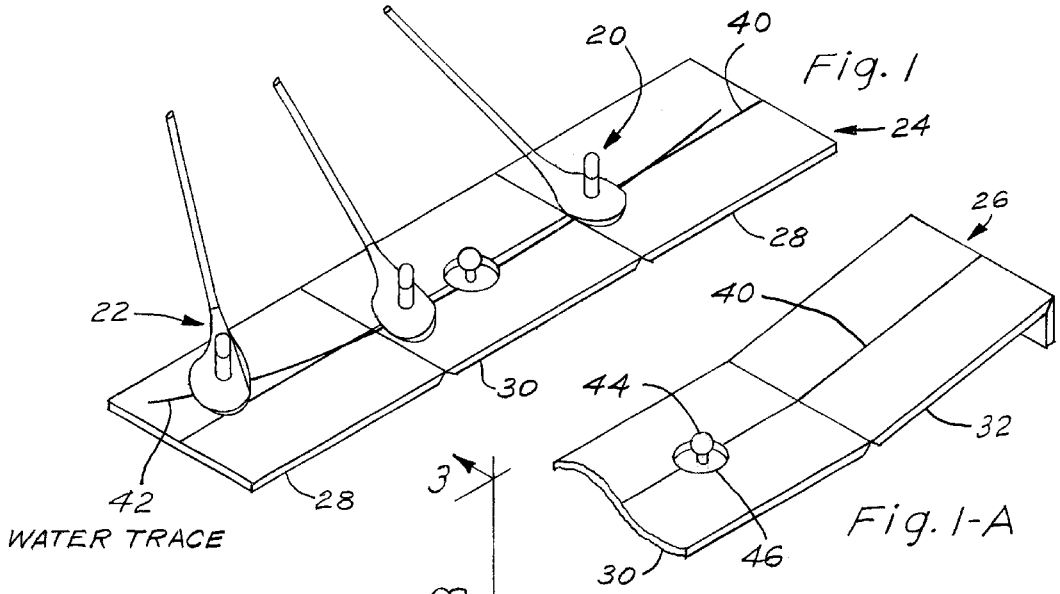
Fig. 1
Fig. 1-A
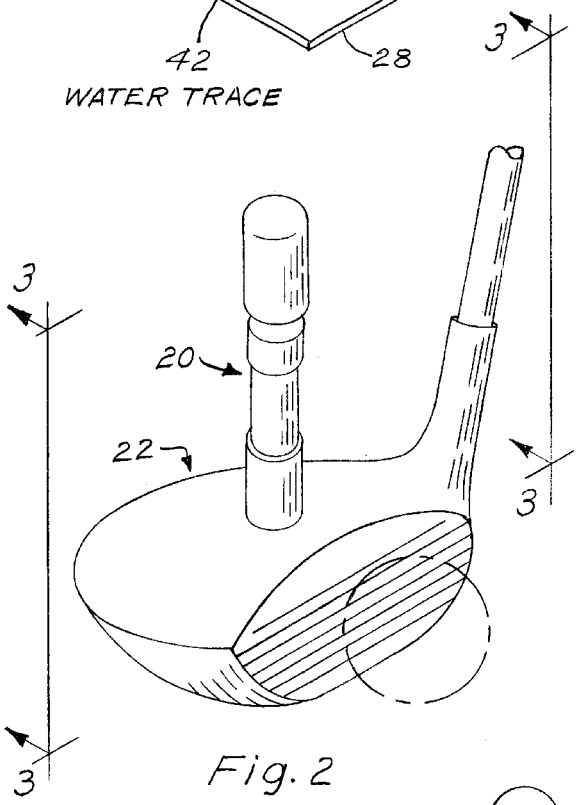
Fig. 2
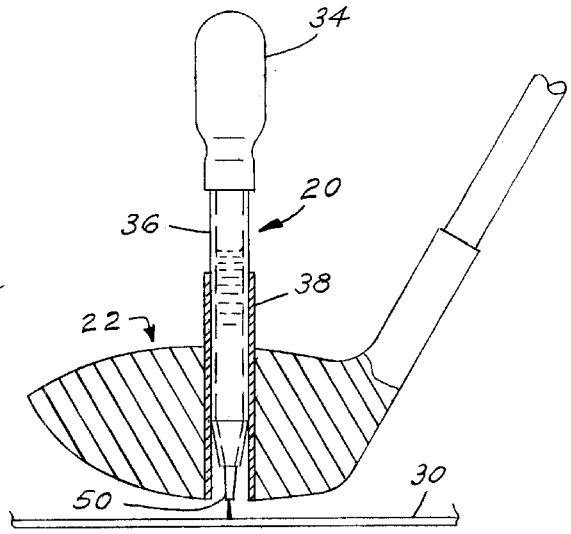
Fig. 3
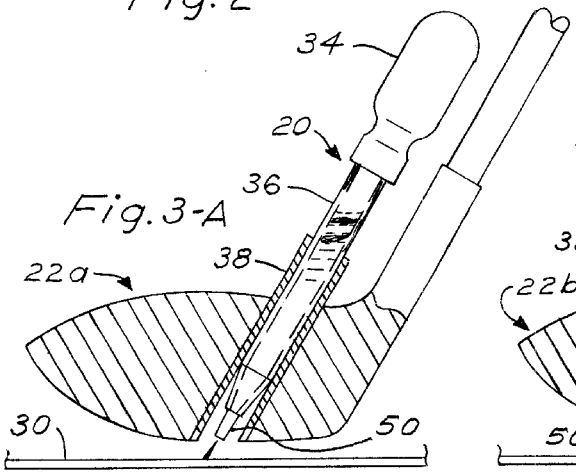
Fig. 3-A
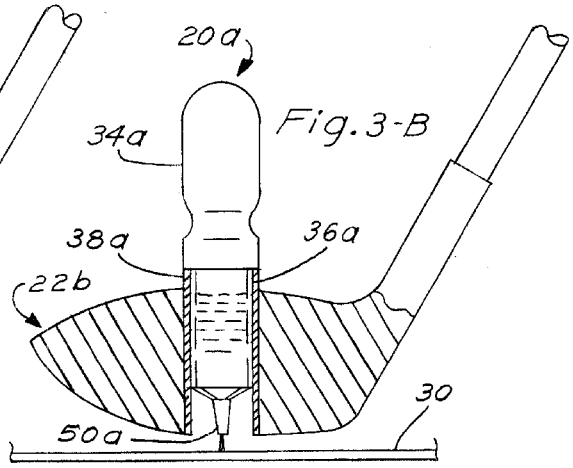
Fig. 3-B

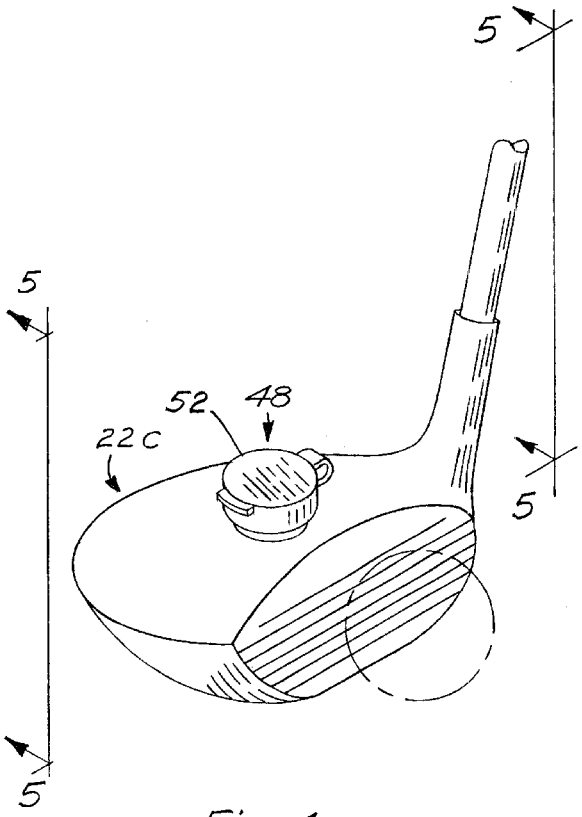
Fig.4
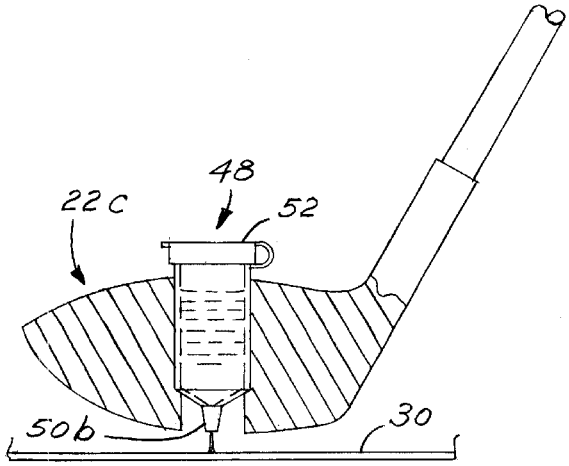
Fig.5
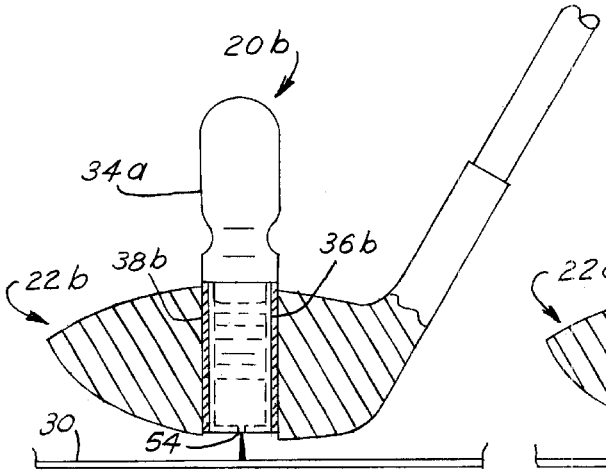
Fig.3-C
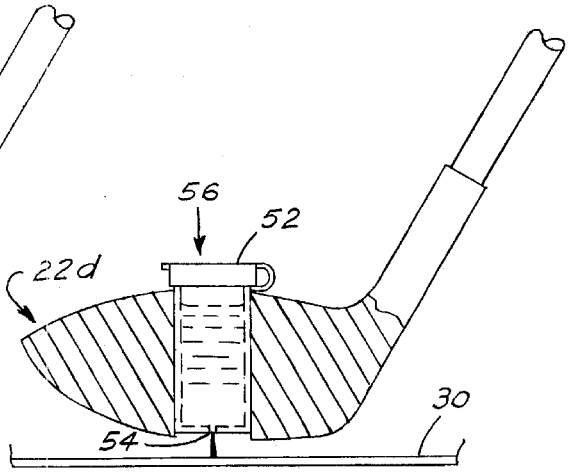
Fig.5-A

GOLFER'S SWING TRACER

This application claims priority to U.S. provisional patent application Ser. No. 60/156,134 filed Sep. 27, 1999.

FIELD OF THE INVENTION

This invention relates to a device for correcting and improving a golfer's swing of the club.

DESCRIPTION OF THE PRIOR ART

Golfer's, whether amateurs or professionals, are continually striving to improve their swings so as to be more consistent in hitting the ball straighter and farther. Some golfers take lessons, many read books and magazines, and many regularly practice on the golf course and driving range. Almost all active golfers persevere in making studious efforts to correct whatever faults might be present in their swings that are perceived to cause erratic behavior of the golf ball.

A great many devices have been invented, patented, and offered on the market to aid golfers in improving their swings. While it is likely that some of these have been and are of value, they have significant problems. Cited for references are a few of the many such patents:

U.S. Pat. No. 2,804,306—by Chedister and Ruocco provides a container to confine a marking substance, such as powder; the container has a small outlet hole near the bottom and is attached to the shaft of a golf club; the marking substance is to issue forth from the outlet hole and mark the grass when the club is swung. Within the container there is an inertia operated valve member to open and close the outlet hole and to agitate the marking substance. However, the use of a marking substance that is colored to contrast with the grass will no doubt result in being thrown fore and aft and being deposited on any nearby objects including persons. Also, the "fine and relatively long outlet hole" would be subject to clogging with powder. And refilling the container with powder would be an awkward operation.

U.S. Pat. No. 3,037,777—by Chedister and Chedister provides a reservoir chamber and a delivery chamber for a marking substance, such as a powder or a somewhat viscous liquid; the marking substance is to issue forth from a small orifice onto the grass when the golf club is swung; the chambers are attached to the shaft of the golf club and there is a wind vane operated valve to open the orifice. However, the same problems apply here in a similar manner as to 2,804,306. Also, the wind vane mechanism appears to be an undue complication requiring experimental adjustment to achieve a desired result.

U.S. Pat. No. 3,037,778—by Chedister and Chedister provides a pressurized container-dispenser for a colored fluid marking material; the marking material is to be forced out through an outlet duct onto the grass when the golf club is swung; the container-dispenser is attached to the shaft of a golf club and there is an adjustable wind vane to open a valve to release the colored fluid marking material. However, the use of a colored marking material is objectionable since it is liable to leave colored markings on persons and objects unintentionally. And, the wind vane mechanism is a complication requiring experimental adjustment to accommodate different swing rates. Further, when the pressure in the container-dispenser is exhausted it will be necessary to replace it with a fresh pressurized container of marking material, entailing some disassembly and re-assembly.

U.S. Pat. Nos. 3,649,028 and 3,649,029—both by Worrell provide means for observing the path of a golf club head during a swing with respect to certain guidelines. The use of luminescent material in an environment substantially devoid of light is required, and an ultraviolet lamp or a special chemical is required.

The path of the club swing is not recorded for subsequent examination and correction.

U.S. Pat. No. 3,687,459—by Swords provides colored scribers to be attached to a golf club for making marks on an underlying sheet of paper so that the club's path may be observed. However, the scribers must make physical contact with the paper, which contact would likely be annoying to the golfer, especially if he is trying to hit a golf ball. And, the paper must be changed frequently.

U.S. Pat. No. 3,776,555—by Hagaman provides a framework apparatus fitted with photoelectric units, electronic circuitry and signaling devices designed to notify a golfer of errors in his swing. The equipment requires special adjustment for each golfer.

U.S. Pat. No. 3,820,130—by Cornelison and Turner provides a photographic record of a golf swing using mirrors, a special camera and electronic circuitry in combination with a special golf club fitted with fiber optic illumination.

U.S. Pat. No. 3,820,133—by Adorney and Davis provides a photographic record of a golf swing using plurality of electronic eyes in combination with a special camera mounted on an instrument panel, all enclosed in a stall where the golfer takes his stance and swings his club.

U.S. Pat. No. 4,911,450—by Rabold provides a means for observing the path of a golf club head during a swing with respect to certain guidelines. A special foreshortened club fitted with lights is required and it is best used in a darkened room. The path of the club is not recorded for subsequent examination and correction.

U.S. Pat. No. 5,470,071—by Hsu provides a liquid receiving chamber shaped to fit on the back of a golf club iron, fastened with a plurality of bands. The liquid chamber has a filling opening at the top and a small emitting orifice on the bottom. This arrangement allows a thin stream of liquid to be released, forming a track on the surface of the earth when the golf club is swung. However, the liquid chamber, shaped like the head of a golf club iron, would not likely fit snugly with the wide variety of golf club iron or wood or metal-wood heads in common use. And, it would be awkward to attach the liquid chamber onto the iron head using a plurality of band chambers.

U.S. Pat. No. 5,620,376—by Hsu provides a liquid receiving chamber with a small orifice which, when clamped to a golf club shaft, will create a liquid track on the surface of the earth owing to centrifugal force and inertia when the golf club is swung in a normal manner. However, the liquid track will be offset from the actual path of the club "sweet spot". Refilling the liquid chamber would be an awkward operation. The orifice end of the liquid chamber is close to the ground at the heel of the club head and is in danger of hitting the ground, causing breakage. The clamp will, in all probability, scratch or mar the finish on the golfer's club shaft.

What is needed is a simple, inexpensive device which will clearly and instantly show the golfer the path of his golf club head, following the club head's passage through the golf ball. Then, when the golfer sees the visual trace of his clubs head's path after passing through the ball location he can discern how his swing is at variance from the ideal and he can then use this evidence to make corrections. Such a device could be used outdoors or indoors, in bright daylight or ordinary room lighting; at a driving range, in any yard or park, in a garage, room or basement. And it could be used either with a standard golf ball, a practice ball or with no ball.

Specifically what is needed is an actual, functional golf club of customary design which has an enclosed water dispensing swing tracer which will immediately show the path of the golfer's swing on an underlying mat having a blotter-like surface. A thin stream of water will be projected onto the mat by centrifugal and inertial forces as a result of the golfer's swing, leaving a visible trace.

Enclosing the water dispensing swing tracer unit within a hole through the golf club head serves to align the tracer of water with the club's "sweet spot", to protect the tracer unit from damage, and to avoid the use of external attachments. This device will require no adjustments and will be ready to use time after time, needing only to be refilled with a small amount of water after numerous swings of the golf club.

Further, the mat will show the water trace indoors or outdoors and in any kind of lighting. Also, the water traces will readily evaporate, obviating any need to erase them. The mat will have imprinted thereon a center line and perhaps other guide lines. The mat might also have a hole on the center line through which a golf ball can be teed up.

For a golfer to use this device he need only pick up the golf club, lay down the mat, fill the enclosed tracer with a few cubic centimeters of water and begin either hitting the ball or swinging through an imaginary ball. In any case, the trace left on the mat will follow directly after the club's "sweet spot".

OBJECTS AND ADVANTAGES

Accordingly, several objects and advantages of my invention are:

a. To provide a simple but effective and reliable device which will leave a visible trace of golf club's swing with a jet of water (or other liquid) projected onto a mat by centrifugal and inertial forces.

b. To provide a golfer with a trace of his swing so that he will have immediate visual evidence of how his swing may deviate from the ideal; thus giving the golfer clear indication of what correction is needed; and to provide golf teachers with a valuable tool.

c. To furnish a golf club with means for producing a golfer's swing trace such that the means are essentially enclosed in a cavity within the club's head, requiring no external attachments to the club.

d. To furnish a golf club of customary design enclosing a container of water within the club's head such that a thin stream of water issuing form a nozzle will produce a trace of the golfer's swing.

e. To provide a device which will emit a thin stream of water to show the trace of a golfer's swing a number of successive times before refilling, yet which can be refilled easily and quickly.

f. To provide a mat to record the water trace which may be used time after time and which will allow rapid evaporation, obviating the need for erasing.

g. To provide a mat which may have marks printed thereon as guides for proper golf strokes and the mat may also have a hole to locate a tee and ball.

h. To provide a device which can be used with a standard golf ball, a light weight practice ball, or without a ball.

i. To provide a mat which may be reversed end for end and/or turned over, offering four reversible surfaces, in effect.

j. To provide a device which will clearly record the trace of a golfer's swing in any common lighting condition from ordinary room lighting to bright daylight.

DESCRIPTION OF DRAWINGS

FIG. 1 is a pictorial view of the Golfer's Swing Tracer invention in action.

FIG. 1-A is a partial pictorial view showing the mat assembly with an elevated end segment.

FIG. 2 is a pictorial view of golf club head with the longitudinal axis of the water reservoir tracer tube, nozzle, and squeeze bulb assembly mounted vertically.

FIG. 3 is a sectional view through the golf club head as indicated by the arrows in FIG. 2.

FIG. 3-A is similar to FIG. 3 except that in 3-A the water reservoir tracer tube assembly is mounted parallel to the club shaft.

FIG. 3-B is similar to FIG. 3 except that in FIG. 3-B the water reservoir tracer tube assembly is shorter and larger in diameter.

FIG. 3-C is similar to FIG. 3-B except that in FIG. 3-*c* the water tracer assembly has a small diameter orifice in lieu of a nozzle.

FIG. 4 is a pictorial view of a golf club head with a water tracer tube assembly having a cap in lieu of a squeeze bulb.

FIG. 5 is a sectional view through the golf club head as indicated by the arrows in FIG. 4.

FIG. 5-A is similar to FIG. 5 except that in FIG. 5-A the water tracer assembly has a small diameter orifice in lieu of a nozzle.

REFERENCE NUMERALS IN DRAWINGS

20 Refillable Water Tracer Assembly
20*a* Low Profile Water Tracer Assembly
20*b* Low Profile Water Tracer Assembly with Small Diameter Orifice in lieu of Nozzle.
22 Golf Club with vertical Water Tracer Assembly
22*a* Golf Club with Water Tracer Assembly parallel to club shaft.
22*b* Golf Club with large diameter vertical Water Tracer Assembly.
22*c* Golf Club with vertical opening for Water Tracer Assembly 48.
22*d* Golf Club with vertical opening for Water Tracer Assembly 56.
24 Mat Assembly.
26 Elevated Mat Assembly.
28 End Segment, Mat Assembly.
30 Center Segment, Mat Assembly.
32 Elevated End Segment, Mat Assembly.
34 Squeeze Bulb.
34*a* Large Diameter Squeeze Bulb.
36 Water Tube
36*a* Large Diameter Water Tube for Tracer Assembly 20*a*.
36*b* Large Diameter Water Tube for Tracer Assembly 20*b*.
38 Liner Tube
38*a* Large Diameter Liner Tube.
38*b* Large Diameter Liner Tube for Tracer Assembly 20*b*.
40 Center Guide Line on Mat Assembly.

42 Water Trace.
44 Golf Ball
46 Hole in Mat Assembly for teeing a Golf Ball.
48 Water Tracer Assembly wit Cap in lieu of Squeeze Bulb.
50 Nozzle for Water Tube 36.
50*a* Nozzle for Water Tube 36*a*.
50*b* Nozzle for Water Tracer Assembly 48.
52 Cap for Water Tracer Assembly 48.
54 Small Diameter Orifice.
56 Water Tracer Assembly with cap in lieu of Squeeze Bulb and Small Diameter Orifice in lieu of Nozzle.

DESCRIPTION OF INVENTION

FIG. 1 is a pictorial view of the Golfer's Swing Tracer invention in action wherein a golf club assembly 22 is shown carrying a refillable water reservoir tracer assembly 20 in a vertical position. Also shown is a segmented mat assembly 24 comprising end sections 28 and a center section 30. Mat sections 28 and 30 preferably have blotter-like surfaces and may be connected by hinge means. One or two of sections 28 may be eliminated. Section 30 has a hole in it and a teed-up golf ball is shown therein. A typical water trace 42 is shown on the surfaces of mat assembly 24 and a center-line 40 is imprinted on mat assembly 24.

FIG. 1-A is similar to FIG. 1 except that in FIG. 1-A mat assembly 26 has an elevated end segment 32 at one end in lieu of end segment 28 as in FIG. 1.

FIG. 2 is a pictorial view of a golf club assembly 22 with a vertical opening to accommodate a liner tube 38. Liner tube 38 is tightly fitted into the opening in golf club assembly 22. Refillable water tracer assembly 20 is snugly but removably fitted into liner tube 38.

FIG. 3 is a sectional view through golf club assembly 22 as indicated by the arrows in FIG. 2. Refillable water tracer assembly 20 is shown comprising a water tube 36 with nozzle 50 and a squeeze bulb 34. Also shown is a portion of an edge view of center segment 30 of mat assembly 24.

FIG. 3-A is a sectional view similar to FIG. 3 except that in FIG. 3-A the refillable water tracer assembly 20 is mounted with its longitudinal axis parallel to the club shaft into an opening in golf club assembly 22*a*.

FIG. 3-B is a sectional view similar to FIG. 3 except that in FIG. 3-B a low profile water tracer assembly 20*a* is utilized comprising large diameter water tube 36*a* with nozzle 50*a* and squeeze bulb 34*a*. Large diameter liner tube 38*a* is tightly fitted into the opening in golf club assembly 22*b*. Low profile water tracer assembly 20 is snugly but removably fitted into large diameter tube 38*a*.

FIG. 4 is a pictorial view of a golf club assembly 22*c* with a vertical opening to accommodate water tracer assembly 48.

FIG. 5 is a sectional view through golf club assembly 22*c* as indicated by the arrows in FIG. 4. Water tracer assembly 48 is shown with cap 52 and nozzle 50*b*. Water tracer assembly 48 is tightly fitted into the opening in golf club assembly 22*c*.

OPERATION

FIG. 1 depicts a golf club assembly 22 in motion as swung by a golfer in practice. Enclosed in a hole through the club head is a water reservoir tracer assembly 20 held snugly in place by liner tube 38. Details may be seen more clearly in FIGS. 2 and 3.

As the club 22 is swung a thin stream of water is emitted from water tracer assembly 20, depositing a visible trace of water 42 on mat assembly 24, showing the golfer the exact path of his or her swing. The trace then indicates whether the golfer's swing is on line or not compared to pre-printed guide lines such as 40 on mat assembly 24; outside-in, inside-out, too close, too far out, too high or too low, etc.

Mat assembly 24, having a blotter-like surface of any suitable color, will readily catch the stream of water causing water trace 42 to be immediately visible. Yet, in a very short time trace 42 will evaporate and disappear depending upon ambient temperature and air movement. Thus, erasure is unnecessary. Further, if desired, mat assembly 24 may be reversed end for end and/or turned over, providing four reusable surfaces.

Refillable water tracer assembly 20 is lifted out of liner tube 38 and, using squeeze bulb 34, is filled with water and reinserted into liner tube 38 inside golf club assembly 22. Mat assembly 24 is unfolded and laid on the ground ready for use. The Golfer's Swing Tracer may be used in any convenient location, outdoors or indoors in any ordinary lighting condition. And, it may be used with a standard golf ball or light weight practice ball teed up in the hole in mat assembly 24 or without a ball.

Referring to FIG. 1-A, elevated mat assembly 26, as an alternative embodiment, includes an elevated end segment 32 which will tend to capture a somewhat longer trace of the club's path after passing the ball area.

Referring to FIG. 3-A all elements are the same as in FIG. 3 except that in FIG. 3-A water tracer assembly 20 is mounted with its longitudinal axis parallel to the golf club's shaft so as to be somewhat more directly in the swing plane, as an alternative embodiment.

Referring to FIG. 3-B, all function are the same as in FIG. 3 except that in FIG. 3-B, low profile water tracer assembly 20*a* is substituted for tracer assembly 20 as an alternative embodiment. Tracer assembly 20*a* is shorter and larger in diameter to provide a more pleasing appearance while retaining at least an equivalent water capacity.

Referring to FIGS. 4 and 5, water tracer assembly 48 with cap in lieu of squeeze bulb has been substituted for tracer assembly 20*a*, as an alternative embodiment. Tracer assembly 48 has an even lower profile than does 20*a*. Tracer Assembly 48 in not removed from golf club 22*c* as it remains tightly fitted into golf club 22*c*. Rather, cap 52 is lifted, water poured in and cap 52 is closed. FIG. 3-C and FIG. 5-A are similar to FIG. 3-B and FIG. 5 respectively except that in FIG. 3-C and FIG. 5-A nozzles 50*a* and 50*b* are replaced by a small diameter orifice 54 in each, thus allowing space for larger volumes of water, permitting more swings of the club before refilling.

I claim:

1. In a golf club a device to trace and record the path of a golfer's swing comprising a reservoir tube for water or other flowable material, said reservoir being situated in a hole through the club head, said reservoir having a small diameter orifice at its lower end and having a means for refilling at its upper end wherein said reservoir is removably secured into said hole through the club head, said reservoir having a nozzle with a small diameter orifice at its lower end and having a squeeze bulb fitted onto its open upper end.

2. The golf club claim 1 wherein said reservoir and said hole through the club head are oriented vertically, that is, essentially perpendicular to the sole of the club head.

3. The golf club of claim 1 wherein said reservoir and said hole through the club head are oriented essentially parallel to the shaft of the club.

4. The golf club of claim 1 is wherein said reservoir is tightly fitted into said hole through the club head, said reservoir having a nozzle with a small diameter orifice at its lower end and having removable cap fitted onto its open upper end.

5. In combination with the golf club of claim 1, a mat with blotter-like surfaces top and bottom, said mat having printed guide lines and a center hole, said mat having means for folding.

6. The combination of claim 5, wherein said mat has a means for elevating one end.

7. In a golf club a device to trace and record the path of a golfer's swing comprising a reservoir tube for water or other flowable material, said reservoir being situated in a hole through the club head, said reservoir having a small diameter orifice at its lower end and having a means for refilling at its upper end; wherein a squeeze bulb is fitted onto said upper end of said reservoir; wherein said reservoir is removably secured into said hole through the club head.

8. In a golf club a device to trace and record the path of a golfer's swing comprising a reservoir tube for water or other flowable material, said reservoir being situated in a hole through the club head, said reservoir having a small diameter orifice at its lower end and having a means for refilling at its upper end; wherein a removable cap is fitted onto said upper end of said reservoir; wherein said reservoir is removably secured into said hole through the club head.

* * * * *